United States Patent [19]

Liller

[11] 3,966,287

[45] June 29, 1976

[54] LOW-VOLTAGE AGING OF CATHODE-RAY TUBES

[75] Inventor: Paul Richard Liller, Lancaster, Pa.

[73] Assignee: RCA Corporation, New York, N.Y.

[22] Filed: June 27, 1975

[21] Appl. No.: 590,914

[52] U.S. Cl. ..... 316/1

[51] Int. Cl.[2] ..... H01J 9/00

[58] Field of Search ..... 316/1, 2, 26, 27, 32

[56] References Cited

UNITED STATES PATENTS

| | | | |
|---|---|---|---|
| 2,917,357 | 12/1959 | Nash et al. | 316/27 |
| 3,357,766 | 12/1967 | Conger, Jr. | 316/1 |
| 3,434,770 | 3/1969 | Angelucci et al. | 316/1 |
| 3,441,333 | 4/1969 | Javorik | 316/26 |
| 3,698,786 | 10/1972 | Gronka | 316/26 |

*Primary Examiner*—Roy Lake
*Assistant Examiner*—James W. Davie
*Attorney, Agent, or Firm*—G. H. Bruestle; L. Greenspan

[57] ABSTRACT

During the low-voltage aging of a completely-assembled and operative cathode-ray tube, a varying positive voltage is applied to the focus electrode and a constant positive voltage is applied to the screen electrode while the cathode is emitting electrons. The effect is to cause electrons from the cathode to scan or spray across the electrode surfaces causing outgassing by electron bombardment of the scanned surfaces. This results in higher and more stable cathode-emission levels.

10 Claims, 6 Drawing Figures

FIG. 1
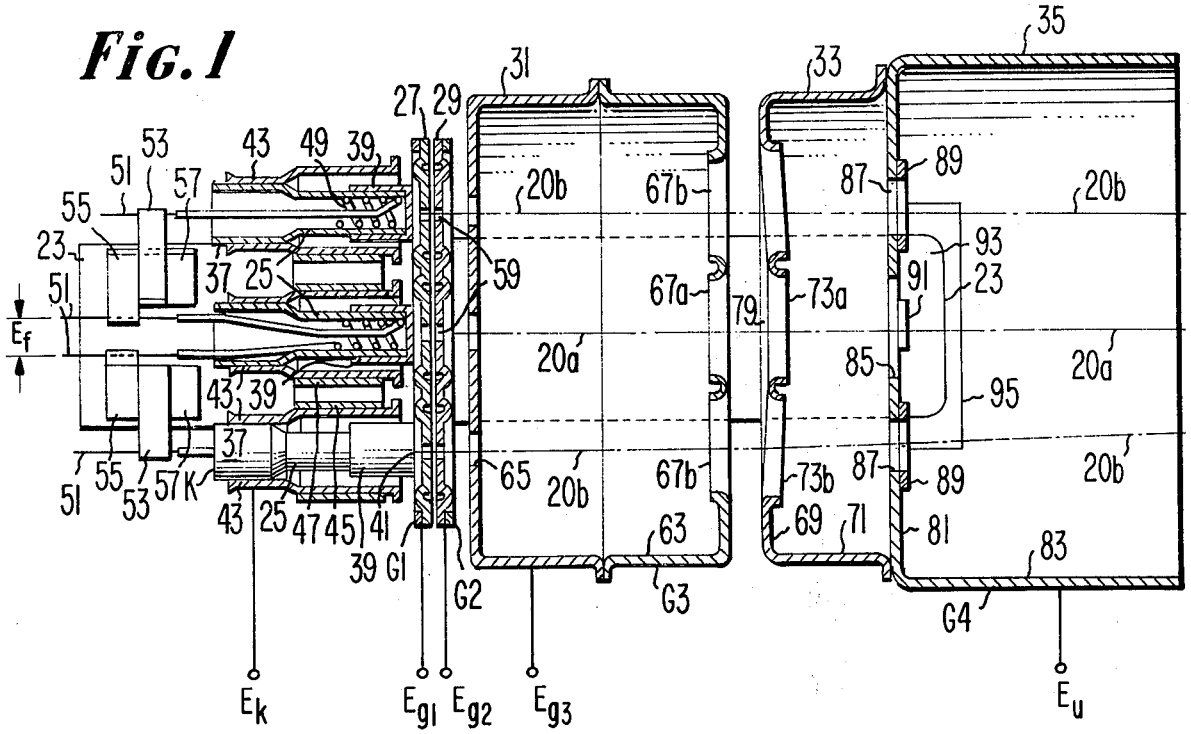
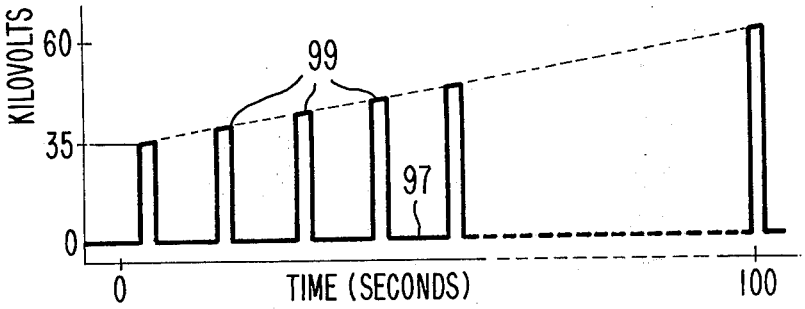
FIG. 2
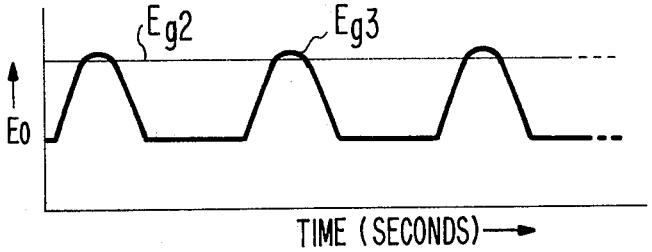
FIG. 3
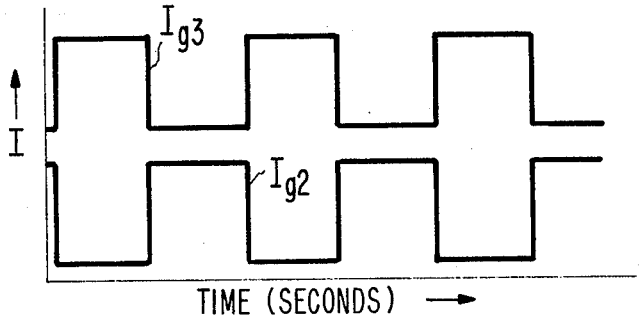
FIG. 4

LOW-VOLTAGE AGING OF CATHODE-RAY TUBES

BACKGROUND OF THE INVENTION

This invention relates to a novel method for electrically processing completely-assembled cathode-ray tubes having electron guns, such as bipotential-focus guns, in which the focus electrode G3 is normally operated at voltages which are independent of the voltages on the control electrode G1, the screen electrode G2, and the high-voltage electrode G4. One or more guns may be installed in such cathode-ray tubes.

In the manufacture of cathode-ray tubes, it is the practice to process the tubes after they have been completely assembled so that the tube becomes operative, the tube operation is stabilized and the operating life is lengthened. For this processing, each gun in the tube is usually subjected in succession to the steps of "spot knocking," "hot shot," "high-voltage aging" and "low-voltage aging."

In one form of the "spot-knocking" step, the cathode, the heater and the low-voltage electrodes G1, G2 and G3 are grounded, and a pulsed positive voltage which peaks at about 200% of the normal ultor voltage is applied to the high-voltage electrode G4 and to the anode (the internal conductive funnel coating) of the tube for about 2 minutes to burn off loose particles which may reside between the electrodes in the gun.

In one form of the hot-shot step, the cathode is activated by heating it to an abnormally high temperature, as by applying about 10 to 12 volts across the cathode heater, where 6 to 7 volts are normally applied, for about 2 minutes, with all of the electrodes and the anode floating electrically.

In one form of the high-voltage aging step, which usually lasts for about 3 to 60 minutes, the cathode is emitting, various combinations of constant voltages including ground potential are applied to the G1, G2 and G3 electrodes, and a high voltage, substantially higher than normal operating ultor voltage, is applied to the high-voltage electrode G4. The high-voltage aging step allows time-related defects to manifest themselves and, in most cases, cure themselves.

In one form of the low-voltage aging step, sometimes called the cathode-aging step, which usually lasts for about 30 to 90 minutes, the cathode is emitting, various combinations of constant positive voltages are applied to the control electrode G1, the screen electrode G2 and the focus electrode G3, and the high-voltage electrode G4 is floating electrically. The low-voltage aging step permits the emission from the cathode to stabilize and the various electrodes to outgas due to bombardment by electrons from the cathode. Outgassing of the electrodes occurs principally during exhaust baking, particularly during rf induction heating of the electrodes just prior to tipping-off the tube, and again in each of the above-described processing steps. Nevertheless, significant amounts of gas remain in the screen electrode G2 and in the focus electrode G3 which outgas during the subsequent testing and/or during the operation of the tube. The effect of such subsequent outgassing is to lower the initial cathode-emission level from the cathode and/or to cause the cathode emission level to drop subsequently from its initial value.

SUMMARY OF THE INVENTION

In the novel method for processing a completely-assembled cathode-ray tube, during the low-voltage aging step, a varying positive voltage is applied to the focus electrode and a fixed positive voltage is applied to the screen electrode with the cathode operative to emit electrons. The low-voltage aging step is applied for 10 to 100 minutes preferably using, for the varying voltage, a cyclic or pulsed voltage which rises from ground potential to at least 10% and preferably 100% of the constant positive voltage applied to the screen electrode.

The effect of the combination of varying and fixed voltages applied to the focus and screen electrodes is believed to cause electrons from the cathode to scan or spray across surfaces of these electrodes, thereby causing outgassing of the scanned surfaces due to electron bombardment. Comparative tests have demonstrated that tubes processed by the novel method exhibit, on the average, higher initial cathode-emission levels and that the cathode-emission level is more stable than similar tubes aged with processes employing only constant voltages.

BRIEF DESCRIPTION OF THE DRAWINGS

FIG. 1 is a sectional elevational view of an electron-gun mount upon which the novel method is exemplified.

FIG. 2 is a graph illustrating the pulse train employed during the spot-knocking step in the example herein.

FIGS. 3 and 4 are graphs illustrating the relationships with time of the G2 and G3 voltages (FIG. 3) and the currents to the G2 and G3 electrodes (FIG. 4) during the low-voltage-aging step of the invention.

DETAILED DESCRIPTION OF THE PREFERRED EMBODIMENTS

Figure 5:
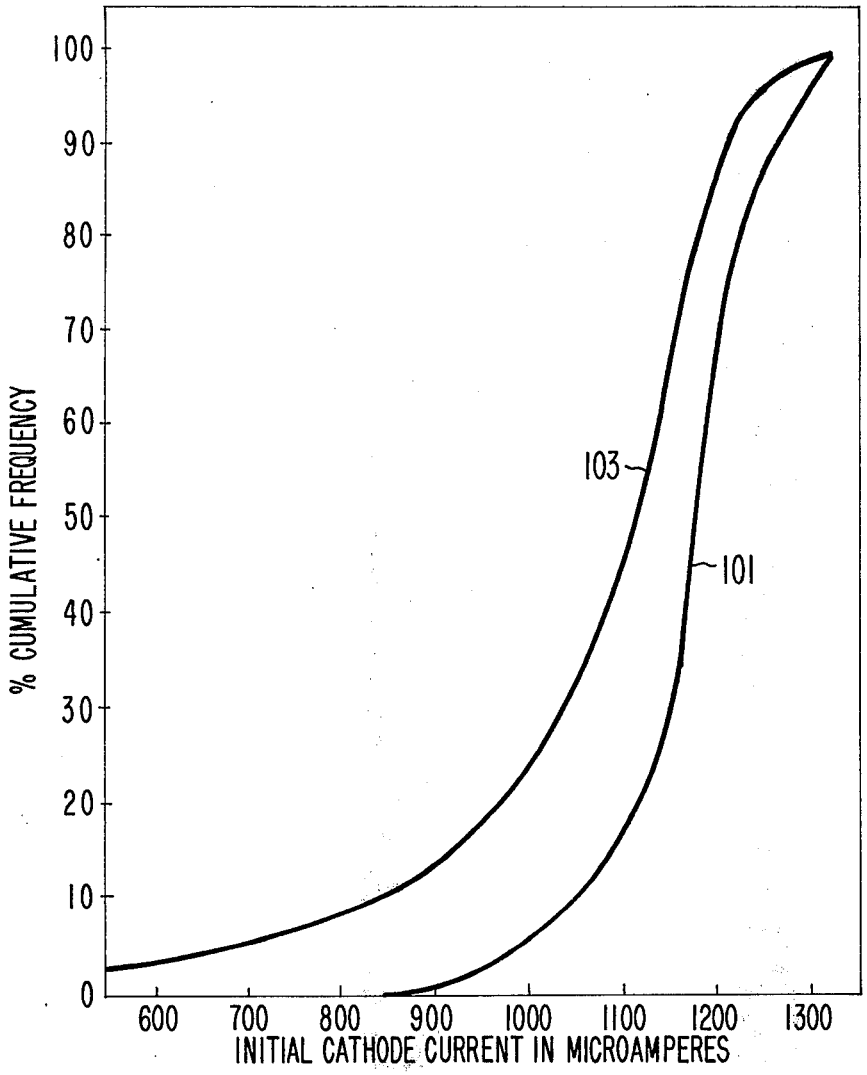
FIG. 5 is a graph of compiled data comparing the initial cathode-emission levels for cathode-ray tubes processed by the novel method with similar tubes processed by a comparable prior method.

The invention may be applied to any electron gun having a cathode and four or more electrodes which are biased independently of one another. One family of such electron guns is referred to as bipotential guns. There may be a single gun or a plurality of guns in the gun mount of the cathode-ray tube. Where there is more than one gun in the mounted, the guns may be in any geometric arrangement. Where there are three guns, as in a color television picture tube for example, the guns may be arranged in a delta array. or in an in-line array, or other array.

The invention will now be exemplified for the tube described in FIGS. 1 and 3 to 8 of U.S. Pat. No. 3,772,554 to Richard H. Hughes. This tube employs a mount assembly 21 comprising three bipotential guns in in-line array shown in longitudinal section in FIG. 1 herein. Each mount assembly comprises two glass support rods 23 on which the various electrodes of the guns are mounted. These electrodes include three equally-spaced co-planar cathodes 25, one for each beam, a control electrode 27, a screen electrode 29, a focusing electrode 31, a high-voltage electrode 33, and a shield cup 35, a spaced along the glass rods 23 in the order named.

Each cathode 25 (also referred to as K) comprises a cathode sleeve 37, closed at the forward end by a cap 39 having an end coating 41 of electron-emissive material and a cathode support tube 43. The tubes 43 are supported on the rods 23 by four straps 45 and 47. Each cathode 25 is indirectly heated by a heater 49 positioned within the sleeve 37 and having legs 51 welded to heater straps 53 and 55 mounted by studs 57 on the rods 23. The control and screen electrodes 27 and 29 (also referred to as G1 and G2 respectively) are two closely-spaced (about 9 mils) flat plates having three pairs of small (about 25 mils) aligned apertures 59 centered with the cathode coatings 41 to initiate three equally-spaced co-planar beam paths including a middle path 20*a* and two side paths 20*b* extending toward the screen of the tube (not shown). The initial portions of the side paths 20*b* are substantially parallel and about 200 mils from the middle path 20*a*.

The focus electrode 31 (also referred to as G3) comprises first and second cup-shaped members 61 and 63, respectively, joined together at their open ends. The first cup-shaped member 61 has three medium-sized (about 60 mils in diameter) first G3 apertures 65 close to the grid electrode 29 and aligned respectively with the three beam paths 20*a* and 20*b*. The second cup-shaped member 63 has 3 second G3 apertures including a middle second G3 aperture 67*a* and two side second G3 apertures 67*b*, each about 160 mils in diameter, also aligned with the three beam paths.

The high-voltage electrode 33 (also referred to as G4) is also cup-shaped and comprises a plate 69 positioned close (about 60 mils) to the focus electrode 31, and a flange 71 extending forward toward the tube screen. The base portion 69 is formed with a middle G4 aperture 73*a* and two side G4 apertures 73*b*, which are preferably slightly larger (about 172 mils in diameter) than the adjacent G3 apertures 67*a* and 67*b* of the electrode 31. The middle G4 aperture 73*a* is aligned with the adjacent middle second G3 aperture 67*a* and the middle beam path 20*a*. The two side G4 apertures 73*b* are slightly offset outwardly with respect to the corresponding side second G3 apertures 67*b*. In the example shown, the offset of each side G4 aperture 73*b* may be about 6 mils. The plate 69 is concave with respective to the G3 electrode 31 as shown at 79.

The shield cup 35 comprises a base portion 81, attached to the open end of the flange 71 of the G4 electrode 33, and a tubular wall 83 surrounds the three beam paths 20*a* and 20*b*. The base portion 81 is formed with a large middle shield aperture 85 (about 172 mils) and two smaller side shield apertures 87, about 100 mils in diameter, aligned, respectively with the three beam paths 20*a* and 20*b*. Two shield rings 89 of high magnetic permeability are attached to the base 81, with each ring concentrically surrounding one of the outer shield apertures 87. The shield rings 89 may have an outer diameter of about 150 mils, an inner diameter of about 100 mils, and a thickness of about 10 mils. Two small discs 91 of magnetic material are mounted on each side of the middle beam path 20*a*. The discs 91 may be rings having an outer diameter of about 80 mils, an inner diameter of about 30 mils, and a thickness of about 10 mils.

The two glass rods 23 extend forwardly beyond the mounting portion of the G4 electrode 33, as shown in FIG. 1. In order to shield the exposed ends 93 of the glass rods 23 from the electron beams, the shield cup 35 is formed with inwardly-extending recess portions 95 into which the rod ends 93 extend. The mount assembly is supported in the neck of a cathode-ray tube, at one end by the leads (not shown) from the various electrodes, and at the other end by metal bulb spacers (not shown) which also connect the G4 electrode 33 to the usual conducting funnel coating on the inner wall of the tube.

Cathode-ray tubes may be processed according to the invention in a succession of stations having equipments which can apply, for the various processing steps, programs of voltages to the cathode and the various electrodes of each electron gun in the tube. The tube may be transported by hand or on a conveyer from station to station as is known in the art. One suitable conveyor is described in U.S. Pat. No. 3,698,786 to Edward A. Gronka. The novel method will be exemplified now on the above-described tube transported by hand. At each station, the tube is placed in a holder therefor, and a socket is connected to the base pins of the tube. Each gun is subjected in the following sequence of steps in which the following nomenclature is used:

$E_f$ is the voltage applied across the cathode heater 49,
$E_k$ is the voltage applied to the cathode K,
$E_{g1}$ is the voltage applied to the control electrode G1,
$E_{g2}$ is the voltage applied to the screen electrode G2,
$E_{g3}$ is the voltage applied to the focusing electrode G3,
$E_u$ is the voltage applied to the high-voltage electrode G4 through the connection to the conductive internal funnel coating or anode.

Step 1

Spotknocking

The G4 electrode is grounded ($E_u = 0$). The cathode, the heater and the G1, G2 and G3 electrodes are electrically connected together and to a source which supplies the train of pulses 99 of negative voltage as shown on the curve 97 in FIG. 2 to these elements. The pulses rise from ground potential initially to minus 35±5 kilovolts, increasing linearly to minus 60±5 kilovolts in 90 to 120 seconds. Each pulse is comprised of ac voltage peaking at the value shown and having a frequency of 60 hertz. The positive portion of the ac voltage is clamped to ground potential. The duration of the pulses may be in the range of 0.1 to 0.2 seconds (6 to 12 cycles), and the spacing of the pulses may be in the range of 0.5 to 1.0 second.

Step 2

Cathode Preheating $E_f = 8.8 \pm 0.9$ volts for 60 seconds. All other elements are floating.

Step 3

Hotshot $E_f = 11.2 \pm 0.5$ volts for 90 to 120 seconds. All other gun elements are electrically floating.

Step 4

Cathode Stabilizing $E_f = 8.5 \pm 0.9$ volts for 60 seconds. All other gun elements are electrically floating.

Step 5

High Voltage Aging $E_f = 8.5 \pm 0.9$ volts, $E_k = E_{g1} = E_{g2} = E_{g3} = 0$ (ground potential), and $E_u = 38 \pm 4$ kilovolts for about $20 \pm 4$ minutes.

Step 6

Low Voltage Aging $E_f = 8.5 \pm 0.9$ volts, $E_k = 0$, $E_{g1} = 0$, $E_{g2} = 350 \pm 50$ volts dc, $E_{g3}$ = positive pulses from half-wave rectified 230 volts, 60 hertz ac source and $E_u$ is floating for at least 25 minutes. FIG. 3 shows the relationship of a portion of the curves for $E_{g2}$ and $E_{g3}$ with time. The lowest level of the curve for $E_{g3}$ is about ground potential. FIG. 4 shows the relationship of a portion of the curves for the currents $I_{g2}$ and $I_{g3}$ through G2 and G3 respectively during the same time interval. The lowest levels of the curves for $I_{g2}$ and $I_{g3}$ are 0 to 5% of the cathode current, and the highest levels are about 95% of the cathode current.

Step 7

Cool the tube for at least 2 minutes with all elements floating electrically.

Step 8

Post-Age Spotknocking

Repeat step 1 except apply pulses which peak at $58 \pm 5$ kilovolts for about 3 minutes.

Step 9

Final Cathode Aging

Repeat step 6 for $5.0 \pm 0.5$ minutes.

Step 10

Cool the tube with all elements floating electrically.

FIG. 5 shows by the curve 101 the percent cumulative frequency of the initial cathode emission levels for 170 tubes processed by the novel method exemplified above. The curve 103 is a similar presentation for 96 tubes, similarly processed except that, in steps 6 and 9, $E_{g3} = 0$. By employing the novel low-voltage aging step, a substantially higher proportion of tubes having a higher initial cathode-emission level is produced. Also, but not shown in this graph, is the fact that tubes processed in this comparative test by the novel method did not "slump"; that is, the cathode-emission level did not drop to lower levels from the initial cathode-emission level with time as did many tubes processed by the pror method.

GENERAL CONSIDERATIONS

Figure 6:
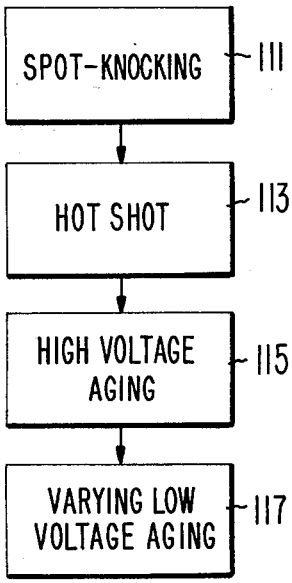
FIG. 6 is a process flow chart illustrating generally the steps, including the novel cyclic cathode-aging step, employed in processing finished cathode-ray tubes according to the invention.

FIG. 6 shows the general sequence of steps for processing completely-assembled cathode-ray tubes by the novel method. These steps, which are exemplified above, are spot-knocking shown by the box 111, hot-shot shown by the box 113, high-voltage aging shown by the box 115 and varying low-voltage aging shown by the box 117. It may be desirable to repeat some of these steps as shown by steps 8 and 9 of the example. Also, it may be desirable to add some steps as shown by steps 2, 4, 7 and 10 of the example. The first three steps shown by the boxes 111, 113 and 115 may be by any of the programs known in the prior art.

The last step shown by the box 117 differs from the prior methods in that a varying positive voltage, which may be pulsating or cyclic, is applied to the focus electrode G3, while a constant positive voltage is applied to the screen electrode G2. Prior methods apply a constant voltage (including ground potential) to one or both the screen electrode G2 and the focusing electrode G3. A varying voltage is not used. While the nature of the novel method is not completely understood, it is believed that the effect of the novel varying low-voltage aging step shown in the box 117 is to cause electrons to spray back and forth over the surfaces of the screen electrode G2 and the focusing electrode G3 resulting in a more thorough outgassing of the areas bombarded by electrons. Most of the liberated gases are sorbed by the getter material in the tube, but a small portion reacts with the cathode coating 41, causing a reduction in emission level, which is believed also to be the cause of cathode slumping. Continued low-voltage aging for at least 10 minutes by the novel method restores the emission to desired levels, and avoids a potential source of slumping during subsequent testing and/or operation.

Almost any combination of a constant positive voltage and a varying positive voltage $E_{g2}$ may be applied to the screen electrode G2 and the focusing electrode G3 respectively. However, it is preferred to apply about a constant positive voltage $E_{g2}$ of 300 to 400 volts to the screen electrode G2. The varying voltage $E_{g3}$ applied to the focus electrode G3 should peak at least at 10% of $E_{g2}$ (preferably 30 volts minimum peak voltage) and preferably at about 100% of $E_{g2}$, although higher peak voltages can be used. The varying voltage $E_{g3}$ should have a minimum or trough voltage of about ground potential. The sum of $I_{g2}$ and $I_{g3}$ at any time is substantially equal to the cathode current. A convenient and preferred varying voltage for applying to the focusing electrode G3 is a positive half-wave rectified 60-cycle ac voltage which peaks at about 300 to 400 volts. However, pulses of various peaks, durations and frequencies may be used.

The novel low-voltage aging step may be applied for a total of 10 to 100 minutes, although a total of about 25 to 40 minutes is preferred. It has been found that the varying potential on the G3 electrode does not have to be applied for the full period of the aging step. Excellent cathode emission levels have been obtained when a varying G3 voltage was applied for as little as 25 percent of the low-voltage aging time. During the balance of the period, ground potential or a constant positive voltage is applied to G3.

I claim:

1. In a method of processing a completed cathode-ray tube having an electron gun including a cathode, a control electrode, a screen electrode, a focus electrode and a high-voltage electrode, the method including the steps of spot-knocking, hot-shot, high-voltage aging and low-voltage aging, the improvement comprising applying a varying positive voltage to said focus electrode and a constant positive voltage to said screen electrode during the low-voltage aging step of said processing.

2. The method defined in claim 1 wherein said varying positive voltage is a half-wave rectified AC voltage.

3. The method defined in claim 1 wherein said varying positive voltage is a half-wave rectified 60 cycles AC voltage having peak voltages of at least 10% of said constant positive voltage.

4. In a method for processing a completed cathode-ray tube having an electron gun comprising a cathode, a control electrode, a screen electrode, a focus electrode and a high-voltage electrode, the method including the steps of spot-knocking, hot-shot, high-voltage aging and low-voltage aging, during the low-voltage aging step, the step of applying ground voltage to said cathode and said control electrode, a constant positive voltage of about 300 to 400 volts to said screen electrode, a varying positive voltage to said focus electrode, said varying voltage having voltage peaks of at least 10% of said constant positive voltage, said cathode being operative to emit electrons and said high-voltage electrode being permitted to float electrically.

5. The method defined in claim 4 wherein said varying positive voltage has peaks of about 300 to 400 volts and has minimums at about ground potential.

6. The method defined in claim 4 wherein said step is applied for 10 to 100 minutes.

7. The method defined in claim 5 wherein said step is applied for about 25 to 40 minutes.

8. The method defined in claim 5 wherein said varying positive voltage is a half wave rectified alternating current voltage.

9. The method defined in claim 5 wherein said varying positive voltage is applied for at least 25 percent of the time period that said step is applied, and a constant positive voltage or ground potential is applied for the balance of said time period.

10. The method defined in claim 5 wherein said varying positive voltage is applied for substantially 100 percent of the time period that said step is applied.

* * * * *